US011603780B2

(12) United States Patent
Fresi

(10) Patent No.: US 11,603,780 B2
(45) Date of Patent: Mar. 14, 2023

(54) NOISE ABATEMENT SYSTEM FOR INTERNAL COMBUSTION ENGINES

(71) Applicant: Paolo Fresi, San Teodoro (IT)

(72) Inventor: Paolo Fresi, San Teodoro (IT)

( * ) Notice: Subject to any disclaimer, the term of this patent is extended or adjusted under 35 U.S.C. 154(b) by 0 days.

(21) Appl. No.: 17/597,911

(22) PCT Filed: Sep. 25, 2020

(86) PCT No.: PCT/IT2020/050229
§ 371 (c)(1),
(2) Date: Jan. 28, 2022

(87) PCT Pub. No.: WO2021/059313
PCT Pub. Date: Apr. 1, 2021

(65) Prior Publication Data

US 2022/0298940 A1 Sep. 22, 2022

(30) Foreign Application Priority Data

Sep. 25, 2019 (IT) ..... 102019000017228

(51) Int. Cl.
*F01N 1/06* (2006.01)
*F01N 1/08* (2006.01)
(Continued)

(52) U.S. Cl.
CPC ..... *F01N 1/06* (2013.01); *F01N 1/08* (2013.01); *F01N 1/18* (2013.01); *G10K 11/175* (2013.01); *F01N 2290/04* (2013.01)

(58) Field of Classification Search
CPC ..... F01N 1/06; F01N 1/08; F01N 1/18; F01N 2290/00; F01N 2290/02; F01N 2290/04;
(Continued)

(56) References Cited

U.S. PATENT DOCUMENTS 867,973 A * 10/1907 Hoover ..... F01N 1/18 415/119
1,019,571 A * 3/1912 West ..... G10K 5/00 116/138
(Continued)

FOREIGN PATENT DOCUMENTS

DE 102016206079 A1 * 10/2017
GB 191109335 A 1/1912
(Continued)

OTHER PUBLICATIONS

International Search Report in PCT application PCT/IT2020/050229, dated Dec. 21, 2020.
(Continued)

*Primary Examiner* — Jeremy A Luks
(74) *Attorney, Agent, or Firm* — Oppedahl Patent Law Firm LLC

(57) ABSTRACT

A noise abatement system for internal combustion engines comprising: a containment body (12) equipped with an inlet hole (6) for the entry of exhaust gases from an internal combustion engine, a plurality of expansion chambers (10) placed in sequence and separated by parallel dividing partitions (13), each equipped with a through-hole (4) for the passage of gases placing in fluid communication two neighboring expansion chambers (10); said expansion chambers (10) having two opposing through-holes (4), one as gas inlet and one as gas outlet. A rotating shaft (9) is integrated in a rotating turbine (1), along an axis comprising the center of gravity of the expansion chambers (10) up to an opposite end of the containment body (12), said rotating shaft (9) having placed around said axis and on said shaft (9) rotary fins (3) which open and close the through-holes (4) between expansion chambers (10) alternately and generating a swirling
(Continued)

movement of the flow of gas entering each expansion chamber (10).

13 Claims, 2 Drawing Sheets

(51) Int. Cl.
*F01N 1/18* (2006.01)
*G10K 11/175* (2006.01)

(58) Field of Classification Search
CPC ..... F01N 2290/06; F01N 2290/08; F01N 2290/10
See application file for complete search history.

(56) References Cited

U.S. PATENT DOCUMENTS 1,191,902 A * 7/1916 Leary ..... F01N 1/18 55/DIG. 30
1,276,935 A * 8/1918 Leary ..... F01N 1/18 165/85
1,318,996 A * 10/1919 Hauman ..... F01N 1/18 415/119
1,473,235 A * 11/1923 El Dorado Jones ..... F01N 1/18 181/277
1,885,062 A * 10/1932 Nicolich ..... F01N 1/18 60/315
2,076,827 A * 4/1937 Ross ..... F01N 1/18 181/277
2,313,244 A * 3/1943 Jones ..... F02B 35/02 181/262
3,000,465 A * 9/1961 Bruno ..... F01N 1/18 181/277
3,187,837 A 6/1965 Beeching
5,941,069 A * 8/1999 Heath ..... F01N 1/18 60/307
6,810,992 B1 * 11/2004 Lombardo ..... F01N 1/18 181/227
2007/0095057 A1 * 5/2007 Field ..... F01N 13/082 60/317

FOREIGN PATENT DOCUMENTS

GB 2204639 A 11/1988
GB 2224540 A * 5/1990 ..... F01N 1/18
JP H0240915 U 3/1990
JP H0742427 U 8/1995
KR 20070064525 A * 6/2006
KR 100778067 B1 * 11/2007
KR 20150128329 A * 11/2015
WO WO-02053884 A2 * 7/2002 ..... F01N 1/18
WO WO 02053884 A2 7/2002
WO WO-2004106704 A1 * 12/2004 ..... F01N 1/006
WO WO 2010005186 A2 1/2010

OTHER PUBLICATIONS

Written Opinion in PCT application PCT/IT2020/050229, dated Dec. 21, 2020.

* cited by examiner

NOISE ABATEMENT SYSTEM FOR INTERNAL COMBUSTION ENGINES

TECHNICAL FIELD

The present disclosure relates to a noise abatement system for internal combustion engines which finds application in all vehicles or devices equipped with an internal combustion engine and more in particular, but not exclusively, for internal combustion engines of agricultural machinery or suitable for the maintenance of greenery such as tractors and lawnmowers. A noise abatement system for internal combustion engines including all the mechanisms that allow the abatement of noise suitable for generating inside of each of a plurality of expansion chambers destructive acoustic interference of sound waves with the consequent increase in speed of the gas flow and a decrease in pressure. More details on the elements that make up the noise abatement system will be provided below.

BACKGROUND ART

One of the problems that most afflicts internal combustion engines, more particularly in agricultural machinery or for the maintenance of greenery, is the high noise that disturbs even at a considerable distance. There is therefore a need to reduce the noise generated by the exhaust gases of internal combustion engines, in particular in agricultural machinery or in machinery for green maintenance. Several attempts have been made to reduce the noise produced by the gases with the result of an increase in the average pressure at the outlet of the gases from the engine and therefore with consequent pressure drops, a significant reduction in efficiency and an increase in energy consumption. In the known art, in fact, the reduction of noise occurs due to the slowing of the gases due to the tortuous passage in a large number of expansion chambers which at the same time determines a decrease in engine revolutions and therefore a loss of efficiency. Document WO2010005186A2 20100114 "Rotary muffler for internal combustion engine and internal combustion engine comprising the same" shows a rotating muffler for an internal combustion engine and an internal combustion engine including said rotating muffler. Document WO2010005186A2 20100114 does not include a method for reducing noise for internal combustion engines which includes a rotating turbine equipped with a rotating turbine shaft and rotating fins placed on said turbine shaft which open and close alternately the holes in the dividing partitions of a plurality of consecutive expansion chambers, generating a swirling movement of the gas flow entering each expansion chamber equipped with an open inlet hole and closed output as it is included in the present invention.

The system object of the present invention allows the exhaust gases to exit with reduced noise first inside each expansion chamber and then globally at the exit from the muffler.

The object of the invention is therefore to reduce the acoustic emissions of internal combustion engines without alteration of engine performance and which is free of the drawbacks described above and found in the known art, and, in particular, is easy and economical to implement.

In accordance with the invention, this purpose is achieved by a noise abatement system for internal combustion engines including the technical features set out in one or more of the claims annexed.

A turbine, which the system is equipped with, has multiple functions, including: a) the rotation of the same with the consequent rotation of both the shaft and the fins; b) the impact of the turbine with the gases generates a set of collisions that reduce the sound; c) it has the function of decreasing the pressure in the initial part of the muffler with a consequent improvement of the engine; d) generates the rotation of the shaft and fins and consequently implements the opening and closing of any divider of the muffler; allows a more flexible management of exhaust gases.

Therefore the turbine adapting to the engine revolutions guarantees optimal performance in any performance of the engine itself. Eliminating a further known problem, such as in multiple mufflers, where the highest performance occurs only in a certain range of engine revolutions.

The turbine interacting with the engine and with the gases, opens a new world regarding the limitations that the already known mufflers have, since it decreases or in certain cases it eliminates the resistance of the gases in the escape from the combustion chamber guaranteeing clearly superior performances.

The elements of the system are easily achievable also by extrusion, the materials used for its construction are not necessarily metallic, consequently they can be multiple, or any material that can withstand high temperatures, for example materials that are already used in the field of exhaust terminals. Reduced production costs are therefore expected in view of large-scale use.

The present invention represents a different solution since it allows to reduce not only the noise but also to reduce the pressure of the gases that escape from the combustion chamber and consequently from the engine.

The invention considerably mitigates the problems encountered in the known art, further overcoming the performance of already known mufflers.

DISCLOSURE OF INVENTION

The present invention is a noise abatement system for internal combustion engines including the set of mechanisms and elements that allow the abatement of noise and more particularly, which allow the cancellation of sound waves due to destructive acoustic interference and a reduction in the pressure of the exhaust gases.

A noise abatement system for internal combustion engines characterized by the fact of comprising:

- a containment body equipped with an inlet hole for the entry of exhaust gases from an internal combustion engine, a plurality of expansion chambers placed in sequence and separated by parallel dividing partitions, each equipped with a through-hole for the passage of gases placing in fluid communication two neighboring expansion chambers; said expansion chambers having two opposing through-holes, one as gas inlet and one as gas outlet;
- a device which has a rotating turbine equipped with at least one blade, housed in a first expansion chamber, on which impact the gases coming from the engine, entering the containment body, and to convey the gases towards a first dividing partition of the first expansion chamber and a second expansion chamber with the consequent increase in speed of the gas flow and a decrease in pressure.

The system object of the present invention is suitable for generating a swirling movement of the flow of gas entering each expansion chambers. Each time the gases pass through an expansion chamber, passing through the opening located on the partition through fins that open and close the expansion chambers alternately, they perform a rotary movement encountering a new flow of incoming gas, resulting in the cancellation of the sound waves due to destructive acoustic interference and the consequent reduction of noise.

The exhaust gases arrive at the exit with noise abated first inside each expansion chamber and then globally at the exit from muffler.

The sum of the reductions in the individual expansion chambers results in a significant reduction the overall noise emitted by the exhaust gases.

The characteristics and advantages of the present invention will be evident from the description given below, given by way of non-limiting example, in accordance with the attached figures and further defined in the claims.

BRIEF DESCRIPTION OF DRAWING

The present invention will now be described with reference to the annexed drawings, which illustrate a preferred and non-limiting embodiment thereof.

The same reference numbers in FIG. 1, FIG. 2 and FIG. 3 identify the same or similar elements. With 3 each dividing partition is generically indicated.

Figure 1:
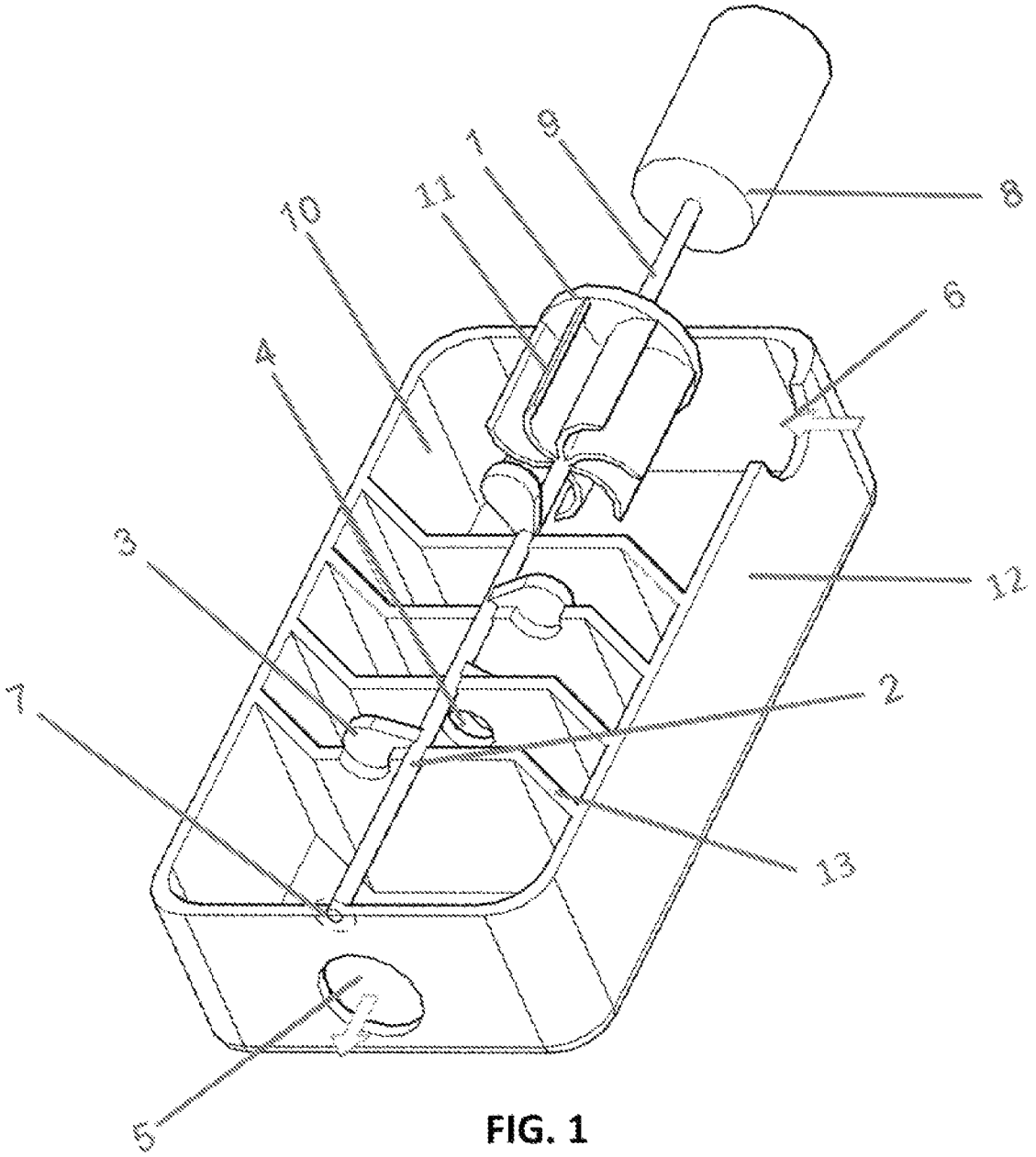
In FIG. 1 four dividing partitions are represented by way of example. Number 4 generically indicates each hole present on the dividing partitions both with reference to the inlet holes and with reference to the outlet holes. With 10 any of the expansion chambers is generically indicated but it can also refer specifically to the first expansion chamber where the turbine blades are positioned, in this last case, the reference to the first expansion chamber will be specified.

Five expansion chambers are shown by way of example in FIG. 1. Furthermore, the drawings are not necessarily to scale. Again, the detailed description that follows does not limit the invention. Rather, the scope of the invention is defined by the attached claims.

Furthermore, the particular features or elements can be combined in any suitable way in one or more embodiments.

FIG. 1 represents an axonometric section of a muffler in which there is a containment body (12) equipped with an inlet hole for the gases from the engine (6) and an outlet for the gases outside (5) and this containment body (12) houses: a) one plurality of expansion chambers in succession (10) separated from each other by parallel dividing partitions (13) and said dividing partitions (13) provided with connection holes (4) for the passage of gases from the engine (5); b) a rotating turbine (1.11); c) a rotating shaft (2) integrated in the turbine body (1) and extending from turbine body (1) and along the barycentric axis of the expansion chambers and up to the end of the containment body (7) and rotating around said axis; d) rotating vanes (3) placed on the turbine shaft (2) which open and close the expansion chambers alternately and in succession, generating a swirling movement of the gas flow entering each expansion chamber; e) a connection (Fig.1, 2-7) between the turbine shaft (2) and the containment body (12).

Figure 2:
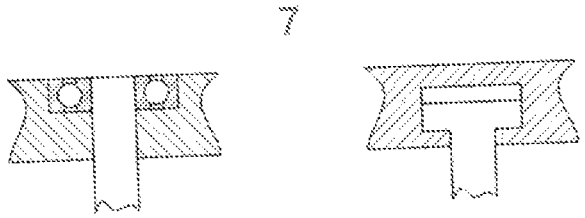

FIG. 2 represents a connection (7) between the turbine shaft (2) and the containment body (12).

Figure 3:
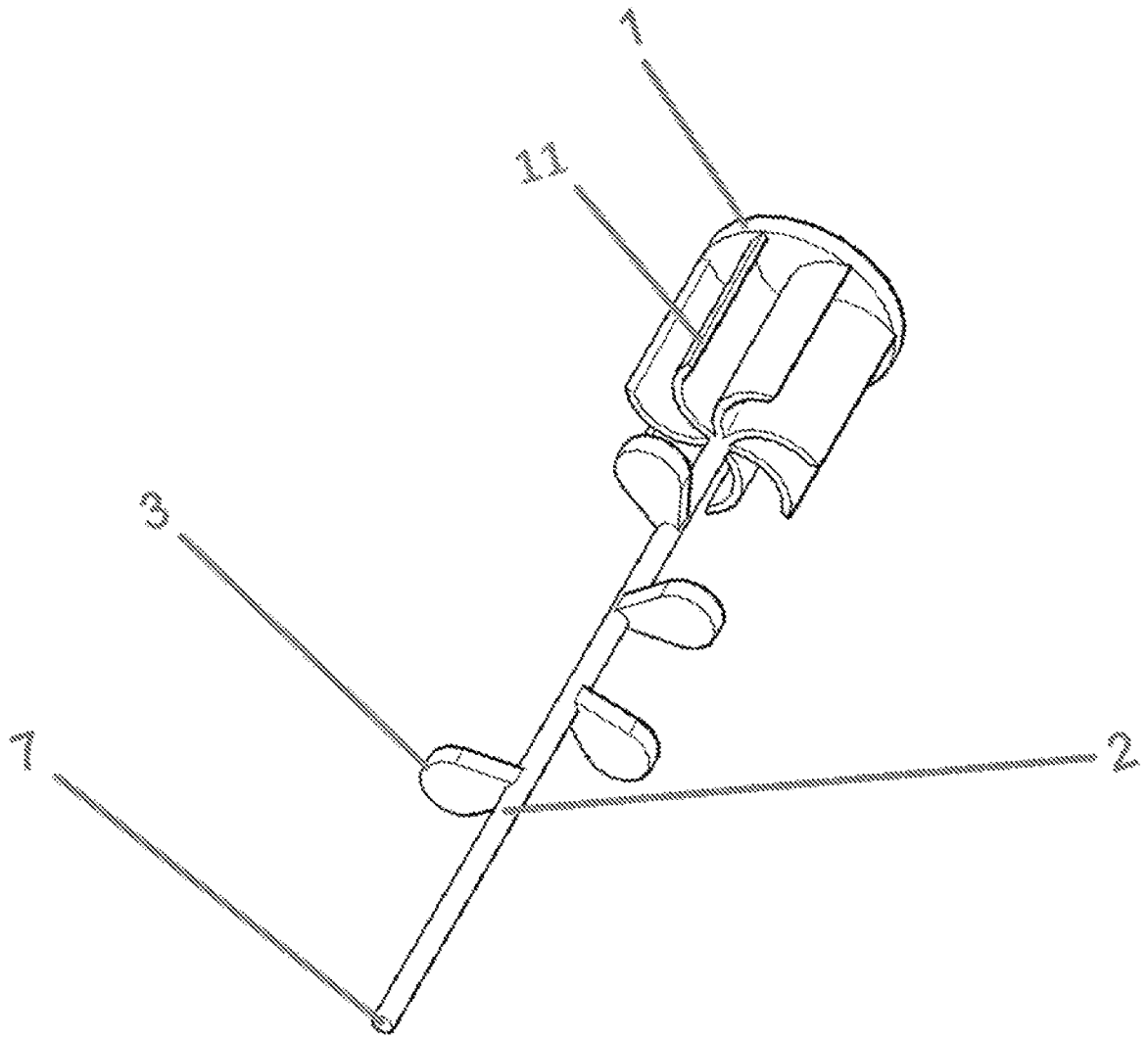

FIG. 3 represents an axonometric view of the turbine (1, 11), the turbine shaft (2), the fins placed on the turbine shaft (3).

DETAILED DESCRIPTION

The noise abatement system being characterized in that a rotating shaft (9) is integrated in a rotating turbine (1), along an axis comprising the center of gravity of the expansion chambers (10) up to an opposite end of the containment body (12), said rotating shaft (9)having placed around said axis and on said shaft (9) rotary fins (3) which open and close the through-holes (4) between expansion chambers (10) alternately and successively, generating a swirling movement of the flow of gas entering each expansion chamber (10).

During engine operation, the gases coming from the engine enter the first expansion chamber (10) passing through the hole (6) placed at the mouth of the containment body and impact on the turbine (1-11) with consequent rotational movement of the turbine, of the turbine shaft (2) and fins (3) located on the turbine shaft.

The turbine shaft takes the motion of the turbine to which it is connected.

The rotation of the turbine generates the rotation of the shaft and the fins placed on the turbine shaft.

More specifically, following the impact with the turbine and even more particularly with the blading of the rotor part of the turbine (11), the gas flow is conveyed towards the bulkhead of the first expansion chamber (10) with the consequent increase in speed of the gas flow and the decrease in pressure. This solution, alone, will cause an increase in performance and a reduction in consumption and harmful emissions of the engines themselves due to the acceleration of the gases entering the muffler or silencer and the reduction of pressure.

Subsequently the gas flow is diverted from the first expansion chamber, where the turbine is located, in the subsequent expansion chamber and subsequently in all the other expansion chambers up to the discharge (5).

The fins (3) are placed on said turbine shaft (2) in such a way that by rotating they open and close in succession and alternately the holes present in the dividing partitions(4) and said alternating way is able to close for each chamber expanding the outlet hole in sequence, leaving the inlet hole open, allowing the portion of gas present inside the expansion chamber to perform a rotary movement and collide with the gas entering the previous chamber called meeting between the gas portion inlet and the portion of gas that carries out the rotary movement determines a phase opposition of the sound waves and the consequent reduction of noise due to destructive acoustic interference.

The destructive acoustic interference of the sound waves produced inside each expansion chamber are able to generate noise reductions in each expansion chamber and an overall reduction in noise at the exit of the gases from the muffler.

More turbine rotation power can be generated by adding a motor to the turbine electric (8) with a consequent increase in the thrust of the gas flow at the inlet of the muffler and greater speed.

In each expansion chamber, a vortex circulation of gas flows is generated due to the temporary closing and opening of the expansion chambers thanks to the fins on the turbine rotation shaft.

Each time the gases pass through an expansion chamber, passing through the opening located on the dividing partition (4) through the fins (3) that open and close the expansion chambers, they make a rotary movement encountering a new flow of gas in entrance generating an impressive noise reduction.

Each expansion chamber alternately has the inlet open and the outlet closed so as to allow the swirling motion of the gases and the consequent phase opposition of the sound waves with consequent reduction of noise due to destructive acoustic interference. This process continues in the subsequent expansion chambers as a chain reaction, with repeated expansion and compression, until it escapes outside through the outlet hole (5) and a consequent dispersion into the external environment, with the reduction of the noise. inside the expansion chambers.

This system allows operation and results that are clearly superior to other mufflers thanks to the movement of the fins that open and close the expansion chambers.

The turbine shaft can be connected (FIG. 1,2-7) through the numerous types of connections already existing, for example, simple bearings operating at high temperatures, such as ball bearings, roller bearings, can be adopted. with gears or even magnetic ones (FIG. 1,2-7) or by inserting a perforated cylindrical rotation chamber positioned inside a cylindrical chamber with a greater depth suitable to compensate for thermal expansion without affecting the performance of the invention.

It is understood that the invention is not limited to the embodiment described above, and that variations and improvements can be made without leaving within the scope of the following claims.

The dimensions of the turbine, the shaft and the number of fins must be adequate for the engine used and the volume of gases that pass through it as well as the number of expansion chambers.

It is possible to have higher performances than the system object of the present invention by simply extending the shaft (9), adding further opposing fins and connecting a small electric motor (8) to the turbine, thus synchronizing the device with the engine revolutions, to increase the rotation speed of both the turbine (1) and the shaft (2) and the fins (3). With the increase in the rotational speed of the turbine (1) there will be a decrease in pressure, since the flow of the burnt gases arrives faster and with less loss of engine power and better performance than the mufflers already on the market.

Therefore different dimensions fall within the scope of the system object of the present invention.

The invention claimed is:

1. A noise abatement system for internal combustion engines suitable for generating inside of each of a plurality of expansion chamber destructive acoustic interference of sound waves, said system including:

a containment body equipped with an inlet hole for the entry of exhaust gases from an internal combustion engine, a plurality of expansion chambers placed in sequence and separated by parallel dividing partitions, each equipped with a through-hole for the passage of gases placing in fluid communication two neighboring expansion chambers; said expansion chambers having two opposing through-holes, one as gas inlet and one as gas outlet;

a device which has a rotating turbine equipped with at least one blade, housed in a first expansion chamber, on which impact the gases coming from the engine, entering the containment body, and to convey the gases towards a first dividing partition of the first expansion chamber and a second expansion chamber with the consequent increase in the speed of the gas flow and a decrease in pressure, the noise abatement system being characterized in that a rotating shaft is integrated in said rotating turbine extending from said rotating turbine body, along an axis comprising the center of gravity of the expansion chambers up to an opposite end of the containment body, said rotating shaft having placed around said axis and on said shaft rotary fins which open and close the through-holes between expansion chambers alternately and successively, generating a swirling movement of the flow of gas entering each expansion chamber, wherein the fins are placed on the said turbine shaft in such a way that by rotating they open and close the present holes alternately in the dividing partitions and said alternate mode it is able to close the outlet hole for each expansion chamber in sequence leaving the entrance hole open allowing the portion of gas present inside the expansion chamber to perform a rotary or vortex movement and of colliding with the gas entering from the previous expansion chamber said meeting between the portion of gas entering and the portion of gas which effects the rotary movement determines a phase opposition of the sound waves and consequent destructive acoustic interference.

2. The noise abatement system according to claim 1 wherein gases coming from the engine enter from the first expansion chamber and in all the other expansion chambers in succession passing through the holes in the dividing partitions.

3. The noise abatement system according to claim 1 wherein gases coming from the engine passing from the hole placed at the entrance of the containment body enter a first expansion chamber and impact on the rotating turbine with consequent rotary movement of the rotating turbine, of the turbine shaft and of the fins placed on the turbine shaft.

4. The noise abatement system according to claim 1 wherein the destructive acoustic interferences of the sound waves, produced inside each expansion chamber, are able to generate noise reductions in each expansion chamber.

5. The noise abatement system according to claim 1 in which the device adapts to the revs of the engine.

6. The noise abatement system according to claim 1 where dimensions of the shaft turbine and the number of fins vary according to the motor power.

7. The noise abatement system according to claim 1 characterized by the use of a material that can withstand a high temperature.

8. The noise abatement system according to claim 1, wherein the rotating turbine is supercharged by applying an electric motor to said rotating turbine suitable for decreasing the exhaust gas pressure.

9. The noise abatement system of claim 1, further characterized in that the destructive acoustic interference determines a consequent reduction of the noise.

10. The noise abatement system of claim 4, further characterized in that the destructive acoustic interferences of the sound waves, produced inside each expansion chamber, are able to generate an overall reduction of noise at the exit of the gas from the muffler.

11. The noise abatement system of claim 5, further characterized in that the adapting to the revs of the engine guarantees the functioning of the system to any range of the engine.

12. The noise abatement system of claim 6, further characterized in that the varying of dimensions and number of fins provide a wider operating range.

13. The noise abatement system of claim 8, further characterized in that the supercharging increases the exhaust gas speed, improving its performance.

* * * * *